US009450282B2

(12) United States Patent
Kawata

(10) Patent No.: US 9,450,282 B2
(45) Date of Patent: Sep. 20, 2016

(54) CONNECTION STRUCTURE BETWEEN A WAVEGUIDE AND A SUBSTRATE, WHERE THE SUBSTRATE HAS AN OPENING LARGER THAN A WAVEGUIDE OPENING

(71) Applicant: NEC Corporation, Tokyo (JP)

(72) Inventor: Muneyasu Kawata, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 14/397,048

(22) PCT Filed: Apr. 23, 2013

(86) PCT No.: PCT/JP2013/002730

§ 371 (c)(1),
(2) Date: Oct. 24, 2014

(87) PCT Pub. No.: WO2013/161279

PCT Pub. Date: Oct. 31, 2013

(65) Prior Publication Data

US 2015/0109068 A1 Apr. 23, 2015

(30) Foreign Application Priority Data

Apr. 25, 2012 (JP) ..... 2012-099655

(51) Int. Cl.

| | |
|---|---|
| ***H01P 5/107*** | (2006.01) |
| ***H01P 1/04*** | (2006.01) |
| ***H01P 5/08*** | (2006.01) |
| ***H01P 11/00*** | (2006.01) |

(52) U.S. Cl.

CPC ..... *H01P 5/107* (2013.01); *H01P 1/042* (2013.01); *H01P 5/08* (2013.01); *H01P 11/002* (2013.01); *H01P 11/003* (2013.01); *Y10T 29/49018* (2015.01)

(58) Field of Classification Search

CPC ..... H01P 5/107; H01P 1/042
USPC ..... 333/26, 254
See application file for complete search history.

(56) References Cited

U.S. PATENT DOCUMENTS

2003/0042993 A1 3/2003 Sayanagi et al.
2007/0052504 A1* 3/2007 Fujita ..... H01P 5/107 333/238

(Continued)

FOREIGN PATENT DOCUMENTS

CN 101772859 A 7/2010
JP 2007-336299 A 12/2007

(Continued)

OTHER PUBLICATIONS

Chinese Notification of First Office Action corresponding to Chinese Application No. 201380021963.3, dated Oct. 10, 2015, 11 pages.

(Continued)

*Primary Examiner* — Benny Lee
(74) *Attorney, Agent, or Firm* — Wilmer Cutler Pickering Hale and Dorr LLP

(57) ABSTRACT

Provided are a new connection structure connecting a high frequency circuit and a waveguide which allows a substrate opening size to be made common without causing deterioration of a transmission line conversion characteristic, and a manufacturing method of the connection structure.
The connection structure includes a module substrate (1) on which the high frequency circuit (11) is mounted and a transmission line conversion means (9, 7) is provided between the high frequency circuit and the waveguide (3), a waveguide conductor (8) in which the waveguide is formed, and a mother substrate (2) which is provided on the waveguide conductor and includes an opening having a size larger than an opening size (d) of the waveguide, and the module substrate is fixed to the mother substrate so as to cover the opening of the mother substrate and a choke is formed utilizing a space among the module substrate, the mother substrate, and the waveguide conductor.

10 Claims, 4 Drawing Sheets

(56) References Cited

U.S. PATENT DOCUMENTS

| | | | | |
|---|---|---|---|---|
| 2007/0262828 | A1* | 11/2007 | Fujita | H01P 5/107 333/26 |
| 2010/0038775 | A1* | 2/2010 | Camiade | H01P 5/107 257/728 |
| 2011/0057741 | A1 | 3/2011 | Dayan et al. | |
| 2011/0156844 | A1 | 6/2011 | Wakabayashi et al. | |

FOREIGN PATENT DOCUMENTS

| | | | |
|---|---|---|---|
| JP | 4261726 | B2 | 4/2009 |
| JP | 2009-111837 | A | 5/2009 |
| JP | 2009-296491 | A | 12/2009 |
| TW | 200840133 | A | 10/2008 |
| WO | WO-2010/125835 | A1 | 11/2010 |

OTHER PUBLICATIONS

Extended European Search Report corresponding to European Application No. 13781138.6, dated Nov. 9, 2015, 13 pages.

International Search Report corresponding to PCT/JP2013/002730, dated Jul. 23, 2013 (3 pages).

* cited by examiner

CONNECTION STRUCTURE BETWEEN A WAVEGUIDE AND A SUBSTRATE, WHERE THE SUBSTRATE HAS AN OPENING LARGER THAN A WAVEGUIDE OPENING

CROSS-REFERENCE TO RELATED APPLICATIONS

This application is a national stage application of International Application No. PCT/JP2013/002730 entitled "Connection Structure Connecting High Frequency Circuit and Waveguide and Manufacturing Method for Same," filed on Apr. 23, 2013, which claims the benefit of priority of Japanese Patent Application No. 2012-099655, filed on Apr. 25, 2012, the disclosures of each of which are hereby incorporated by reference in their entirety.

TECHNICAL FIELD

The present invention relates to a connection structure connecting a substrate which mounts a high frequency (RF) circuit and a waveguide, and a manufacturing method for the connection structure.

BACKGROUND ART

In the case where a substrate, provided with an RF circuit, is connected to a waveguide, there arise problems that reflection, transmission loss, and leakage of an electromagnetic wave are increased, and various connection structures have been proposed for solving the problem.

Patent literature 1 (hereinafter "PTL1") discloses a connection structure connecting a dielectric substrate, on the surface of which a signal transmission line is formed, to a waveguide via an insulating connection member which is provided with a through hole having the same size as the inner diameter of the waveguide. Also patent literature 2 (hereinafter "PTL2") discloses a structure connecting a high frequency module to a waveguide substrate via a dielectric substrate and proposes a structure in which electromagnetic wave leakage is suppressed by means of providing a choke groove around a waveguide hole of the waveguide substrate and further providing a land around a through hole having the same size as the waveguide hole of the dielectric substrate.

CITATION LIST

Patent Literature

[PTL1]
Japanese Patent No. 4261726
[PTL2]
Japanese Patent Laid-Open No. 2007-336299

SUMMARY OF EMBODIMENTS OF THE INVENTION

Technical Problem

In the above patent literatures, however, it is necessary to provide an opening having substantially the same size as the waveguide in the connection member or the dielectric substrate which is to be connected to the waveguide, and it is necessary to provide a substrate including an opening having a different size for each of different frequency bands. That is, depending on the frequency band, it is necessary to change not only the RF module but also the substrate opening size, causing a complicated manufacturing process and a high cost.

Accordingly, an object of the present invention is to provide a new connection structure connecting a high frequency circuit and a waveguide which allows the use of a single substrate opening size without causing deterioration of a transmission line conversion characteristic, and a manufacturing method for the connection structure.

Solution to the Problem

A connection structure according to the present invention is a connection structure for connecting a high frequency circuit and a waveguide and includes a first substrate on which the high frequency circuit is mounted and a transmission path conversion means is provided between the high frequency circuit and the waveguide, a waveguide conductor in which the waveguide is formed, and a second substrate which is provided on the waveguide conductor and includes an opening having a size larger than an opening size of the waveguide, wherein the first substrate is fixed onto the second substrate so as to cover the opening of the second substrate, and a choke is formed utilizing a space among the first substrate, the second substrate, and the waveguide conductor.

A manufacturing method of a connection structure according to the present invention is a manufacturing method of a connection structure for connecting a high frequency circuit and a waveguide, and includes the steps of providing a first substrate on which the high frequency circuit is mounted and a transmission path conversion means is provided between the high frequency circuit and the waveguide; a waveguide conductor in which the waveguide is formed, and a second substrate including an opening having a size larger than an opening size of the waveguide, fixing the second substrate onto the waveguide conductor so as to cause centers of the openings in the waveguide and the second substrate to coincide with each other, fixing the first substrate onto the second substrate so as to cover the opening of the second substrate, and forming a choke among the first substrate, the second substrate, and the waveguide conductor.

Advantageous Effects of Embodiments of the Invention

According to the present invention, it is possible to standardize the opening size of the second substrate among different frequency bands to be used without causing deterioration of the transmission path conversion characteristic.

DETAILED DESCRIPTION OF EMBODIMENTS OF THE INVENTION

A connection structure according to an exemplary embodiment of the present invention to be explained next includes a first substrate (module substrate) on which an RF circuit section and a transmission line conversion section are put together, a second substrate (mother substrate) in which an opening is formed having a size larger than the opening size of a waveguide, and a waveguide conductor in which the waveguide is formed. The mother substrate is fixed onto the waveguide conductor so as to cause the centers of the openings in the waveguide and the mother substrate to coincide with each other and the module substrate is fixed onto the mother substrate so as to cover the opening of the mother substrate. A conductor is disposed around the opening of the mother substrate to form a choke shorting face. A choke is formed by utilizing a space among the module substrate, the mother substrate, and the waveguide so as to keep a characteristic necessary for an opening of a waveguide.

In this manner, by means of forming the opening of the mother substrate which is sufficiently larger than the size of the opening in the waveguide, an actual size of the opening can be determined by the conductor of the waveguide, a conductor of the mother substrate, and a conductor of the module substrate, and the size of the opening can be the same among the different frequency bands to be used. Moreover, since a choke structure is formed only by means of mounting a module substrate and a waveguide, the module substrate and the waveguide each having an opening corresponding to a frequency band to be used on the mother substrate having the large opening, it is possible to perform waveguide connection by a simple process without causing characteristic deterioration. In the following, embodiments of the present invention will be explained with reference to the drawings.

1. First Exemplary Embodiment

Figure 1:
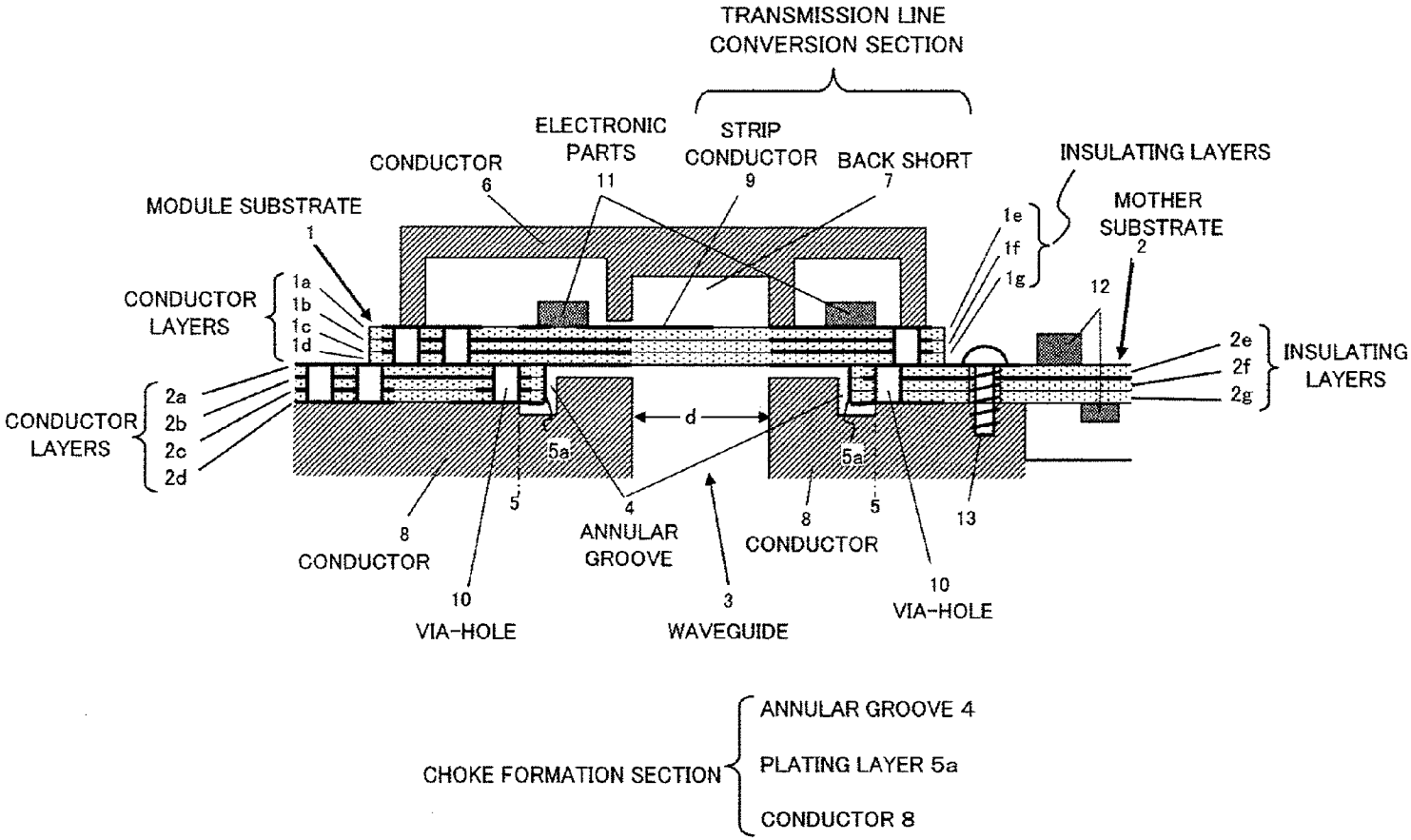
FIG. 1 is a cross-sectional view of a connection structure connecting an RF module and a waveguide according to a first exemplary embodiment of the present invention.

As shown in FIG. 1, in an RF module connection structure according to a first exemplary embodiment of the present invention, a module substrate 1 is surface-mounted onto a mother substrate 2, and the mother substrate 2 is fixed with a screw 13 to a conductor 8 serving as a tube wall of a waveguide 3. Thereby, the conductor 8 is fixed so as to function as electrical ground (GND) for the mother substrate 2 and also not to cause a gap. However, because of thickness variation of the mother substrate 2, a soldering state and warpage of the module substrate 1, and the like, it is difficult to align the conductor 8 so that it contacts the module substrate 1 which is surface-mounted on the mother substrate 2, without a gap. Conversely, since it is easy to create a design so as to intentionally cause a gap to be generated between the module substrate 1 and the conductor 8, by designing this gap as a choke to form a choke flange, it is possible to perform a simpler waveguide connection. In the following, the configuration of each part will be explained.

An RF circuit section and a transmission line conversion section are put together on the module substrate 1. The RF circuit section includes an amplifier, a matching circuit, and the like, and the circuit size thereof may depend on an apparatus design. The transmission line conversion section is configured with a back short 7 which is formed by means of cutting out a conductor 6 in a part having the same size as the opening size of the waveguide 3, and a strip conductor 9. Electronic parts 11 are mounted on the module substrate 1. The electronic parts 11 are RF circuit parts and include an amplifier, a matching circuit, and the like. In FIG. 1, while a shield of the back short 7 and the electronic parts 11 is integrally formed by the conductor 6, it is not necessarily integrally formed, and the shield of the electronic parts 11 may be formed as needed also for each of the parts.

Further, the module substrate 1 is a multi-layered substrate, and is configured here with conductor layers 1*a*, 1*b*, 1*c*, and 1*d* and insulating layers 1*e* and 1*f* therebetween. The above electronic parts 11 are mounted on the top conductor layer 1*a*, and the strip conductor 9 extended from the electronic parts 11 is formed in a region corresponding to the opening of the waveguide 3. In each of the other conductor layers 1*b*, 1*c*, and 1*d*, a conductor is not formed in the region corresponding to the opening of the waveguide 3. The module substrate 1 is attached to the mother substrate 2 in alignment with the opening of the mother substrate 2 by a method such as soldering. The layers between the top conductor layer 1*a* and the bottom conductor layer 1*d* are connected electrically to one other by via-holes or the like, and connected here to the conductor 8 which is equivalent to GND through via-holes of the mother substrate 2. Note that, the number of the conductor layers of the module substrate 1 depends on a design requirement and the conductor layers 1*a*, 1*b*, 1*c*, and 1*d* shown in FIG. 1 are one example.

An opening for the waveguide connection is formed in the mother substrate 2 with a size larger than the opening size d of the waveguide, and a conductor plating layer 5*a* is formed on the edge face of the opening of the mother substrate 2 in contact with a conductor layer 2*d*. The mother substrate 2 is fixed to the conductor 8 by the screw 13. Further, electronic parts 12 are mounted on the mother substrate 2. The electronic parts 12 include a CPU, a power supply circuit, an IF circuit, and the like. Further, the mother substrate 2 is a multi-layered substrate, and, while a configuration including conductors 2*a*, 2*b*, 2*c*, and 2*d* and insulating layers 2*e*, 2*f*, and 2*g* therebetween is illustrated, the number of the conductor layers depends on a design requirement. Note that each of the opening of the waveguide 3 and the opening of the mother substrate 2 is rectangular or circular.

The waveguide 3 and an annular groove 4 are integrally formed in the conductor 8. The mother substrate 2 and the module substrate 1 are fixed so as to cover the waveguide 3 of the conductor 8, and thereby a choke is configured with the annular groove 4, the conductor 1*d* of the module substrate 1, the conductor plating layer 5*a* and the conductor layer 2*d* of the mother substrate 2. While preferably the via-holes 10 are formed as close as possible to the opening end face of the mother substrate 2, the positions thereof are determined by design.

As described above, the choke is configured with the annular groove 4, the conductor layer 1*d* of the module substrate 1, the conductor plating layer 5*a* and the conductor layer 2*d* of the mother substrate 2. Accordingly, by setting the effective distance from the wall face of the waveguide 3 to the deepest face 5 of the annular groove 4 to be half a wavelength $\lambda_g$ ($d=\lambda_g/2$) inside the waveguide, it is possible to manufacture a connection structure having a small loss or leakage of a high frequency signal in a desired frequency band to be used, in a simple process.

Note that the via-hole 10 may be filled with a conductor as a build-up via. In the case of the build-up via, even if the deepest face 5 of the annular groove 4 is extended to under the via-hole 10, the choke characteristic is not affected. Accordingly, the embodiments provide an advantage that a design restriction on the portions of the via-holes and annular grooves is eliminated.

2. Second Exemplary Embodiment

Figure 2:
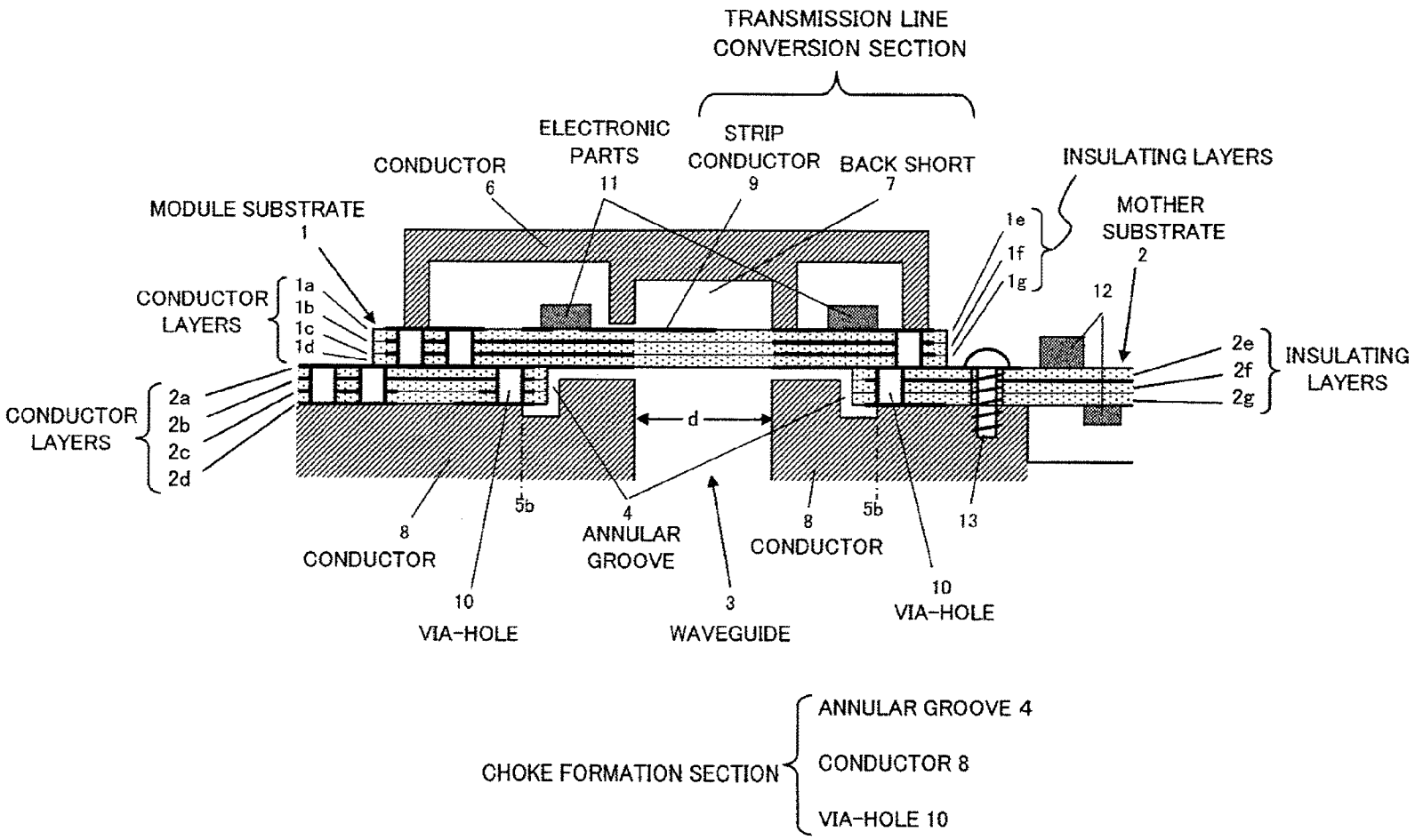
FIG. 2 is a cross-sectional view of a connection structure connecting an RF module and a waveguide according to a second exemplary embodiment of the present invention.
Figure 3:
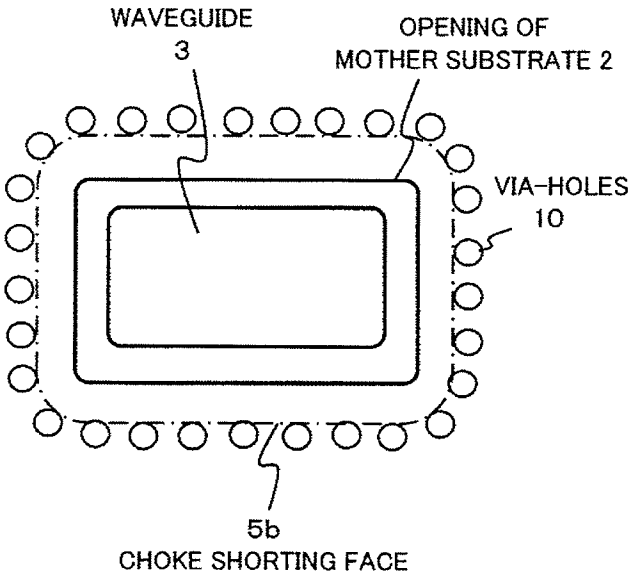
FIG. 3 is a plan view of the connection structure shown in FIG. 2.

In the above first exemplary embodiment, as shown in FIG. 1, the choke is configured with the annular groove 4, the conductor layer 1 *d* of the module substrate 1, and the conductor plating layer 5*a* and the conductor layer 2*d* of the mother substrate 2. However, the present invention is not limited to this configuration. As shown in FIG. 2, the choke can be also configured using the via-holes 10 instead of the conductor plating layer 5*a*. Hereinafter, a second exemplary embodiment of the present invention will be explained with reference to FIG. 2 and FIG. 3, provided that the configuration except the choke is the same as that of the first exemplary embodiment shown in FIG. 1, and the same reference numbers are attached and explanation will be omitted. In the following, explanation will be provided focusing on a choke configuration.

In FIG. 3, the via-holes 10 are provided so as to surround the opening of the mother substrate 2 at predetermined intervals (preferably at intervals not larger than ¼ of a signal wavelength, and, while a better characteristic is obtained as the intervals are smaller (e.g., λ/40), these intervals depend on a design condition), and these arranged via-holes 10 form a choke shorting face 5*b*. That is, in FIG. 2, the choke is configured with the annular groove 4, the conductor layer 1*d* of the module substrate 1, and the via-holes 10. By appropriately designing the distance from the wall face of the waveguide 3 to the choke shorting face 5*b*, it is possible to manufacture a connection structure having a small loss and leakage of a high frequency signal in a desired frequency band to be used, as in the first exemplary embodiment.

3. Third Exemplary Embodiment

Figure 4:
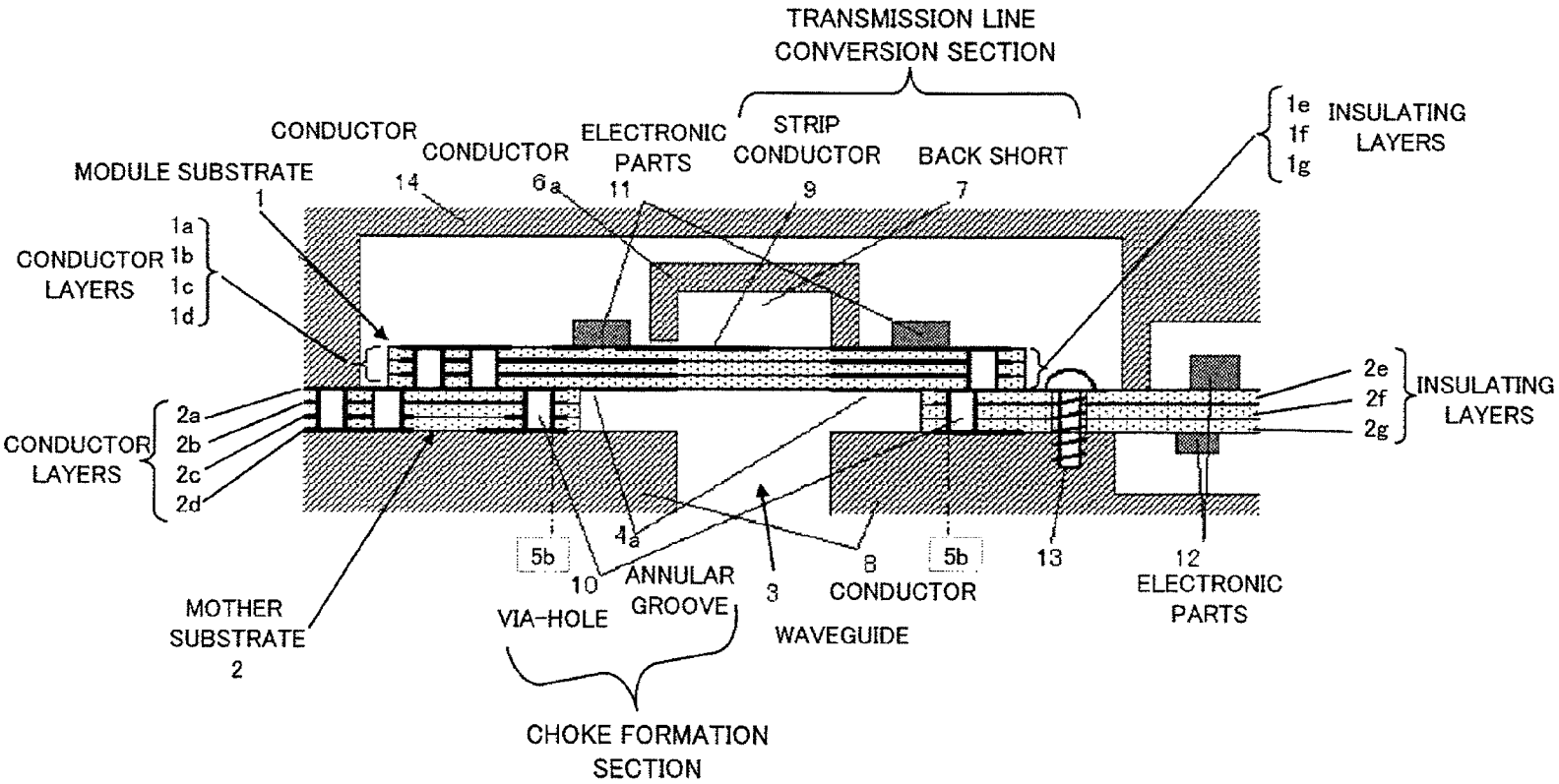
FIG. 4 is a cross-sectional view of a connection structure connecting an RF module and a waveguide according to a third exemplary embodiment of the present invention.

In the above first and second exemplary embodiments, as shown in FIG. 1 and FIG. 2, the choke is configured by means of forming the annular groove 4 around the waveguide 3 in the conductor 8. However, it is also possible to form the choke by a simplified annular groove 4*a* as shown in FIG. 4 and the via-holes 10 if a characteristic, such as a bandwidth, which is required for the transmission line conversion, permits it. When the configuration is simplified in this manner, it is expected to make the process of the conductor 8 easy and to obtain yield improvement and cost reduction.

Specifically, as shown in FIG. 4, in an RF module connection structure according to the present embodiment, a choke is formed using as an annular groove 4*a* a space formed by the waveguide 3, the opening of the mother substrate 2 and the module substrate 1 thereabove without forming the groove in the conductor 8 in which the waveguide 3 is formed. That is, the choke is configured with the conductor 8, the conductor layer 1*d* of the module substrate 1, and conductors in the via-holes 10 of the mother substrate 2. The arrangement of the via-holes 10 is as illustrated in FIG. 3.

Further, a conductor 6*a* configuring the back short 7 may be provided separately, and a conductor 14 may be formed for shielding the circuit by the electronic parts 11 and the circuit by the electronic parts 12. Note that, since the other members are the same as those of the embodiments shown in FIG. 1 and FIG. 2, the same reference numbers are provided and their explanations will be omitted.

Also in the present embodiment, by appropriately designing the distance from the wall face of the waveguide 3 to the choke shorting face 5*b*, it is possible to manufacture a connection structure having a small loss and leakage of a high frequency signal in a desired frequency band to be used, in a simple process. At this time, since the groove is not formed in the conductor 8 in which the waveguide 3 is formed and the choke is configured using the opening of the mother substrate 2 and the via-holes 10, it is possible to further simplify the manufacturing process.

4. Effect

According to the above-mentioned embodiments of the present invention, by providing the RF circuit and the transmission line conversion section for the module substrate 1 and providing an opening larger than the opening size of the waveguide for the mother substrate 2 at a position corresponding to the position where the module substrate 1 is attached, it is possible to reduce frequency-dependent design factors of the mother substrate 2, and to make the mother substrate 2 common without being limited to a frequency band to be used.

INDUSTRIAL APPLICABILITY

The present invention can be applied generally to a high frequency apparatus which requires a connection between a wiring substrate and a waveguide.

REFERENCE SIGNS LIST

1 Module substrate
1*a* to 1*d* Conductor layer
1*e* to 1*g* Insulating layer
2 Mother substrate
2*a* to 2*d* Conductor layer
2*e* to 2*g* Insulating layer
3 Waveguide
4, 4*a* Annular groove
5 Deepest part of an annular groove
5*a* Plating layer
5*b* Choke shorting face
6, 6*a* Conductor in back short side
7 Back short
8 Conductor in waveguide side
9 Strip conductor
10 Via-hole
11 Electronic parts
12 Electronic parts
13 Screw
14 Conductor

The invention claimed is:

1. A connection structure for connecting a high frequency circuit and a waveguide, comprising:

a first substrate on which the high frequency circuit is mounted and a transmission line conversion means is provided between the high frequency circuit and the waveguide;

a waveguide conductor in which the waveguide is formed; and a second substrate which is provided on the waveguide conductor and has an opening having a size larger than an opening size of the waveguide, wherein the first substrate is fixed onto the second substrate so as to cover the opening of the second substrate, and a choke is formed utilizing a space among the first substrate, the second substrate, and the waveguide conductor.

2. The connection structure according to claim 1, wherein the choke includes the waveguide conductor, a conductor layer of the first substrate, and a conductor passing through the second substrate.

3. The connection structure according to claim 1, wherein the choke includes the waveguide conductor, a conductor layer of the first substrate, and a plurality of via-holes passing through the second substrate which are disposed around the opening of the second substrate at predetermined intervals.

4. The connection structure according to claim 3, wherein an effective distance between an inner wall of the waveguide and a deepest face of the choke is set to half a wavelength inside the waveguide.

5. The connection structure according to claim 1, wherein an effective distance between an inner wall of the waveguide and a deepest face of the choke is set to half a wavelength inside the waveguide.

6. A manufacturing method of a connection structure for connecting a high frequency circuit and a waveguide, comprising the steps of:

providing a first substrate on which the high frequency circuit is mounted and a transmission line conversion section is provided between the high frequency circuit and the waveguide, a waveguide conductor in which the waveguide is formed, and a second substrate including an opening having a size larger than an opening size of the waveguide;

fixing the second substrate onto the waveguide conductor so as to cause centers of the openings in the waveguide and the second substrate to coincide with each other;

fixing the first substrate onto the second substrate so as to cover the opening of the second substrate; and forming a choke among the first substrate, the second substrate, and the waveguide conductor.

7. The manufacturing method of a connection structure according to claim 6, wherein the choke includes the waveguide conductor, a conductor layer of the first substrate, and a plurality of via-holes passing through the second substrate which are disposed around the opening of the second substrate at predetermined intervals.

8. The manufacturing method of a connection structure according to claim 7, wherein an effective distance between an inner wall of the waveguide and a deepest face of the choke is set to half a wavelength inside the waveguide.

9. The manufacturing method of a connection structure according to claim 6, wherein the choke includes the waveguide conductor, a conductor layer of the first substrate, and a conductor passing through the second substrate.

10. The manufacturing method of a connection structure according to claim 6, wherein an effective distance between an inner wall of the waveguide and a deepest face of the choke is set to half a wavelength inside the waveguide.

* * * * *